United States Patent [19]

Oka et al.

[11] 4,276,323

[45] Jun. 30, 1981

[54] PROCESS FOR CONTROLLING OF CHEMICAL COPPER PLATING SOLUTION

[75] Inventors: Hitoshi Oka, Yokohama; Kenji Nakamura, Fujisawa, both of Japan

[73] Assignee: Hitachi, Ltd., Tokyo, Japan

[21] Appl. No.: 106,083

[22] Filed: Dec. 21, 1979

[51] Int. Cl.[3] ..... C23C 3/02

[52] U.S. Cl. ..... 427/8; 427/306; 427/345; 427/443.1; 427/437; 106/1.23; 324/438; 324/71 R; 204/1 T

[58] Field of Search ..... 427/8, 345, 443.1, 437, 427/438; 106/1.23, 1.26, 1.24, 1.27; 118/689

[56] References Cited

U.S. PATENT DOCUMENTS

| | | | |
|---|---|---|---|
| 3,532,519 | 10/1970 | Hirohata et al. | 427/8 |
| 3,951,602 | 4/1976 | Thompson | 106/1.27 |
| 4,096,301 | 6/1978 | Slominski et al. | 427/443.1 |

FOREIGN PATENT DOCUMENTS

| | | | |
|---|---|---|---|
| 2751104 | 5/1978 | Fed. Rep. of Germany | 427/345 |
| 45-32121 | 10/1970 | Japan | 427/437 |
| 45-32122 | 10/1970 | Japan | 427/437 |

*Primary Examiner*—Ralph S. Kendall

*Attorney, Agent, or Firm*—Craig and Antonelli

[57] ABSTRACT

A concentration of copper ions, a concentration of a reducing agent, a concentration of a complexing agent and a pH of a chemical copper plating solution are continuously detected all as potentials, and continuously controlled with a good accuracy.

1 Claim, 1 Drawing Figure

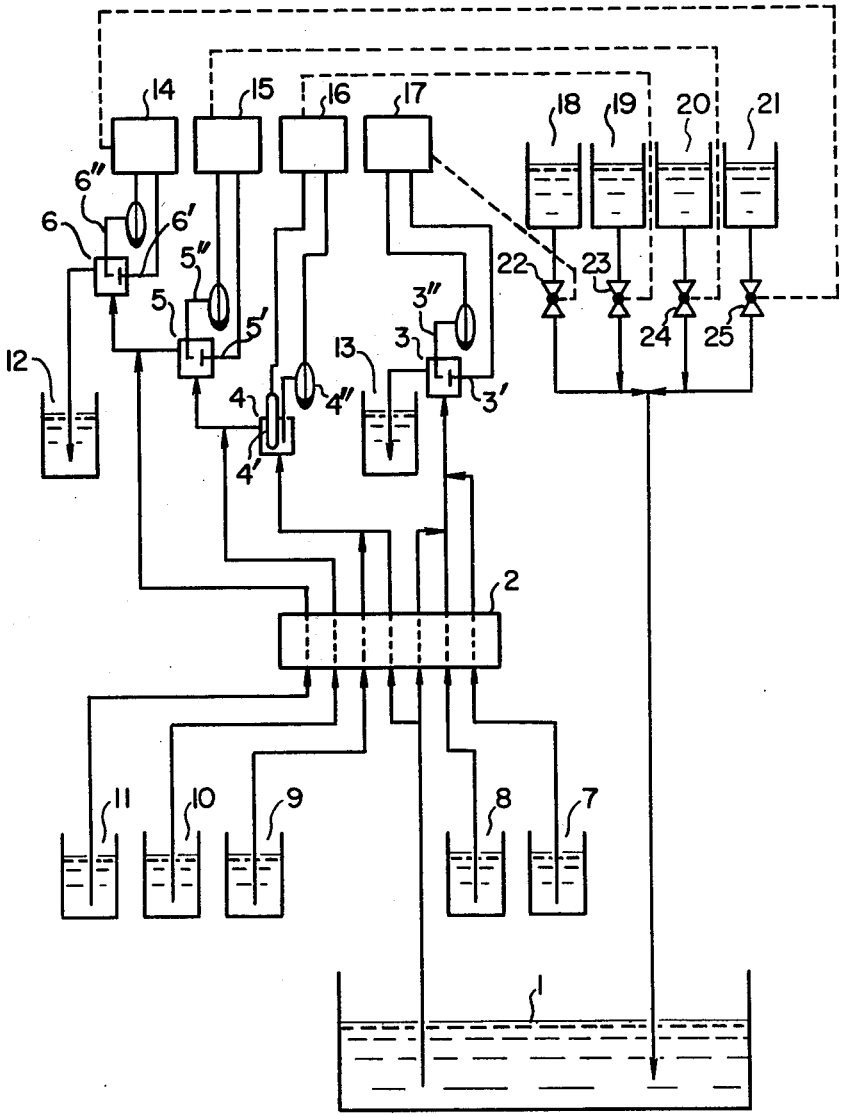
14
15
16
17
18
19
20
21
6″
6
6′
5″
5
5′
3″
3
3′
13
12
4
4″
4′
22
23
24
25
2
11
10
9
8
7
1

PROCESS FOR CONTROLLING OF CHEMICAL COPPER PLATING SOLUTION

BACKGROUND OF THE INVENTION

The present invention relates to a process and an apparatus for controlling a composition of a chemical copper plating solution containing copper ions, a reducing agent, a complexing agent, and a pH-adjusting agent as essential components, and more particularly to a process and an apparatus for continuously and automatically controlling a pH, a concentration of a reducing agent, a concentration of copper ions and a concentration of a complexing agent in a chemical copper plating solution.

When a surface of ABS resin is subjected to a bright plating for decoration, it is the ordinary expedient to carry out a copper substrate plating by chemical copper plating to give an electroconductivity to the surface of the resin. In that case, the mechanical strength of a substrate plating film has been neglected, and thus a composition of a chemical copper plating solution, which gives a great influence upon the substrate plating film, has been only intermittently controlled.

However, recently, conductors have been more often formed directly on the insulating base plates by chemical copper plating. In that case, not only an electro-conductivity, but also mechanical characteristics of the chemical copper plating films have been regarded as important. The mechanical characteristics of a chemical cooper plating film depend upon concentrations of main components in a chemical copper plating solution, and thus it is very necessary to continuously control the composition of a chemical copper plating solution.

A continuous control of a composition of a chemical copper plating solution has been so far carried out as to pH, a concentration of a reducing agent, a concentration of copper ions and a concentration of a complexing agent in the following manner as given by (a) to (d).

(a) pH (Japanese Laid-open Patent Application Specification Ser. No. 44434/78):

A pH of a chemical copper plating solution is measured as a potential by means of a pH meter using glass electrode-calomel electrode, and when there is a difference in potential between the chemical copper plating solution and a fresh chemical copper plating solution, the pH meter emits a signal to drive a control unit, to make up the chemical copper plating solution with a supplementing solution. The pH value can be kept thereby equal to that of the fresh chemical copper plating solution.

(b) Concentration of a reducing agent (Japanese Laid-open Patent Application Specification Ser. No. 65226/78; Japanese Patent Publication No. 32121/70):

Generally, formaldehyde is used as a reducing agent. According to one mode of practice, a concentration of formaldehyde in a chemical copper plating solution can be kept constant by diluting the plating solution with a known amount of a solution, adding a material capable of coloring through reaction with formaldehyde (coloring agent) in excess thereto, measuring a degree of coloring by a colorimeter or a spectrophotometer, for example, by measuring an intensity of transmitted light by means of a phototube and converting it to an electric signal, and driving a control unit according to the electric signal, when required.

According to another mode of practice, a concentration of formaldehyde in a chemical copper plating solution can be kept constant by sampling the chemical copper plating solution, adding sodium sulfite in excess thereto, thereby reacting it with formaldehyde in the sampled plating solution, measuring a change in pH of the sampled plating solution by means of pH meter of the above-mentioned type, since the pH of the sampled plating solution is increased through the reaction, converting the change in pH to an electric signal, and driving a control unit according to the electric signal, when required.

According to other mode of practice, a concentration of aldehyde in a chemical copper plating solution can be kept constant by plating a piece of metal having a given area such as copper, platinum, gold, palladium, etc. in a sampled chemical copper plating solution, measuring a turbidity of the sampled plating solution saturated with a hydrogen gas generated proportionately to the amount of consumed aldehyde by means of a turbidimeter, converting it to an electric signal, and driving a control unit according to the electric signal, when required.

According to further mode of practice, a concentration of aldehyde in a chemical copper plating solution can be kept constant by detecting a concentration of copper ions in the plating solution according to the following manner as described in item (c), since a molar ratio of consumed formaldehyde to copper ions is usually in a range of 2–3, supplementing the copper ions by an amount of consumed copper ions as detected and at the same time adding formaldehyde thereto in an amount 2–3 times as many as the supplemented amount of copper ions.

(c) Concentration of copper ions (Japanese Laid-open Patent Application Ser. No. 44434/78):

A concentration of copper ions in a chemical copper plating solution can be kept constant by adding to the chemical copper plating solution $Cu^{+2}$ in a form of an aqueous $CuSO_4.5H_2O$ solution in a very small excess of the amount necessary for the reaction with a total amount of a free complexing agent, for example, EDTA, contained in the chemical copper plating solution, measuring an equilibrium potential between $Cu^{+2}$ and a very small amount of impurity $Cu^{+}$ present in the plating solution, thereby determining an amount of EDTA in the plating solution, indirectly determining an amount of $Cu^{+2}$ since a ratio of Cu-EDTA compound to free EDTA is constant in the plating solution (a reducibility of a chemical copper plating solution greatly depends upon a ratio of $Cu^{+2}$/a complexing agent, that is, a stability of $Cu^{+2}$ at the complex formation, and EDTA is usually added at a concentration 1.5 to 5 times as high as the concentration of $Cu^{+2}$), emitting a difference in potential from the set potential as a signal, when the measured potential is found to differ from the set potential, and driving a control unit according to the signal.

(d) Concentration of a complexing agent (Japanese Laid-open Patent Application Specification Ser. No. 44434/78):

Compounds of copper and complexing agents such as EDTA in a chemical copper plating solution can be decomposed by making the pH of the chemical copper plating solution lower than 1, thereby bringing all the amount of the complexing agent into a free state. Then, $Ti^{+3}$ is added to the plating solution. When the amount of $Ti^{+3}$ is a little lower than the concentration of $Cu^{+2}$ in the plating solution, an oxidation-reduction potential of copper ions can be determined, for example, by measuring a potential by a platinum-calomel electrode. When the amount of $Ti^{+3}$ added is a little larger than the concentration of $Cu^{+2}$, the oxidation-reduction potential of titanium ions can be determined. The difference in potential represents an amount of copper ions in the plating solution. Since a ratio of the concentration of copper ions to the amount of a complexing agent in a fresh chemical copper plating solution is constant, the concentration of a complexing agent can be indirectly determined thereby. When the measured potential is found to differ from the set potential, a difference in potential from the set value is emitted as a signal to drive a control unit, and the concentration of a complexing agent can be kept constant thereby.

However, the continuous control of a composition of a chemical copper plating solution in the manner as described in the foregoing items (a) to (d) still has the following disadvantages (i) to (iv).

(i) pH:

When the pH of a chemical copper plating solutoin is measured by means of glass electrode-calomel electrode, an error in measurement is significant, because the plating solution has a pH of 11 to 13, and $OH^-$ ions are adsorbed on a glass wall of the electrode, so that the adsorption of $H^+$ ions becomes difficult, and also the accuracy in the measured potential is deteriorated with time, because the glass wall of the glass electrode is gradually attacked by the chemical copper plating solution itself.

Beside the glass electrode, an antimony electrode, and a quinhydrone electrode are known.

However, all of these electrodes are slow in response speed, and troublesome in handling, and thus are not suitable for the continuous control of pH of a chemical copper plating solution.

(ii) Concentration of a reducing agent:

According to the colorimeter or the spectrophotometer, the difference in the intensity of transmitted light due to the different degree of coloring is measured as an electric current by a phototube, and is displayed as a difference in potential, and thus the necessary apparatus will be very expensive. Furthermore, a response speed is so low that the time for measurement is inevitably prolonged, and an accurate control cannot be attained.

When the change in pH of a chemical copper plating solution is measured by adding sodium sulfite to the plating solution for the reaction with formaldehyde, there appears the same disadvantage as mentioned in the foregoing item (i).

When the piece of metal is plated to determine the amount of generated hydrogen by the turbidimeter, the turbidimeter itself is expensive for the same reason as mentioned above, and also the hydrogen gas is not uniformly dispersed in the plating solution, so that the measurement cannot be made accurately. Furthermore, the hydrogen gas cannot be rapidly separated from the plating solution, resulting in a low response speed.

The control of the amount of formaldehyde in view of the measurement of the amount of consumed $Cu^{+2}$ has the disadvantage as described in the following item (iii), and also it is impossible to supplement the amount of formaldehyde consumed by evaporation and self-decomposition.

(iii) Concentration of copper ions:

The change in potential when $Cu^{+2}$ starts to form in a chemical copper plating solution is so small, that the measurement accuracy will be about ±5%, and rather will be much lowered down to ±13% when the plating solution is repeatedly used, on account of the action of $HCOO^-$, $CO_3^-$ and $SO_4^{-2}$ accumulated in the plating solution.

(iv) Concentration of a complexing agent:

The pH control is essential, and the solution containing $Ti^{+3}$ is not stable. Thus, the solution cannot be used for a prolonged time, and also a compound liberting $Ti^{+3}$ is expensive.

The conventional apparatus for controlling a chemical copper plating solution comprises (1) a sampling means of continuously sampling a definite volume of a chemical copper plating solution from a plating tank, (2) a pH meter of measuring a pH of said definite volume of the plating solution sampled by the sampling means by a platinum-calomel electrode, and a means of supplying a pH-adjusting solution to the plating tank according to the measured pH value, (3) a means of supplying $Cu^{+2}$ ions in a very little excess of the amount of free EDTA present in the plating solution to the plating solution leaving the pH meter, a means of measuring an oxidation-reduction potential of copper ions in the plating solution leaving the $Cu^{+2}$ ions-supplying means, thereby determining the amount of copper ions, and a means of controlling copper ions to be supplied to the plating tank according to the determination of the amount of copper ions, (4) a means of acidifying the definite volume of the plating solution sampled by said sampling means, a means of supplying $Ti^{+3}$ ions in a very little excess of the amount of $Cu^{+2}$ ions present in the plating solution to the plating solution leaving the acidifying means, a means of measuring an oxidation-reduction potential of titanium ions in the plating solution leaving the $Ti^{+3}$ ions-supplying means, thereby determining the amount of a complexing agent, and a means of controlling the complexing agent to be supplied to the plating tank according to the determination of the amount of complexing agent. However, said conventional apparatus for controlling the composition of a chemical copper plating solution has said disadvantages (i), (ii) and (iv), and also the control of a concentration of a reducing agent cannot be effected according to the conventional apparatus. This is another great disadvantage.

BRIEF SUMMARY OF THE INVENTION

An object of the present invention is to provide a process and an apparatus for continuously controlling a pH, a concentration of a reducing agent, a concentration of copper ions, and a concentration of a complexing agent of a chemical copper plating solution with a good accuracy.

According to the present invention, pH measurement is carried out in the following manner: a definite volume of an acid solution at a definite concentration is added to a definite volume of a chemical copper plating solution having a pH of 12.3 to adjust the pH to 4–9. The pH of the resulting mixed solution having a pH adjusted to 4–9 is measured as a potential by a combination of glass electrode-calomel electrode. The sensitivity of the pH measurement is about 7 times as high as the conventional sensitivity, because the measurement is carried out in the present invention after the pH has been adjusted to 4–9, and also the glass electrode is never attacked by the plating solution. Accordingly a continuous measurement can be made for a prolonged time.

When the measured potential is found to differ from the potential of a fresh plating solution, the difference in potential is emitted as a signal to drive a control unit, and the plating solution is made up with a supplementing solution, whereby the pH is adjusted to that of the fresh plating solution.

An improvement in the measurement accuracy in the present invention seems to be due to the fact that, for example, when disodium ethylenediaminetetracetate is used as a complexing agent, the following reactions take place at a pH of about 7.5 according to equation (1), and at a pH of about 4.5 according to equation (2), and thus a pH value is sharply changed by addition of a small amount of an acid.

$$L^{4-} + H^{+} = LH^{3-} \quad (1)$$

$$LH^{3-} + H^{+} = LH_2^{2-} \quad (2)$$

wherein $L^{4-}$ in equation (1) represents free ethylenediaminetetracetate ions.

Formaldehyde generally used as the reducing agent in a chemical copper plating solution undergoes the following reaction according to equation (3) by adding to the definite volume of a chemical copper plating solution sulfite ions (for example, sodium sulfite), in excess of the amount necessary for the reaction with all the amount of formaldehyde contained in the plating solutoin on one hand, and an inhibitor for self-decomposition of the sulfite ions on the other hand (for example, sodium carbonate, borax and sodium triphosphate having a buffer action at a pH of 10–12; if a pH is below 10, the sulfite ions are oxidized to sulfate ions, making the analysis impossible, and thus a pH must be 10 or higher, and in view of a pH at the iodine titration according to the following equation (4), a preferable pH is 10–12; or alkali metal salts containing sulfate ions as a decomposition product of the sulfite ions, such as sodium sulfate, potassium sulfate, etc).

$$HCHO + (1+x)Na_2SO_3 + H_2O \rightleftharpoons NaOH + HCH(NaSO_3)OH + xNa_2SO_3 \quad (3)$$

Then, a pH buffer agent having a buffer action with iodine in a neutral zone (pH=6–8) (for example, potassium hydrogen citrate, potassium dihydrogen phosphate, potassium monohydrogen phosphate, sodium citrate, glycine, or potassium hydrogen phthalate) is added thereto to occasion the following reaction according to equation (4). The reaction according to equation (4) hardly takes place below the pH of 6 or above the pH of 8.

$$Na_2SO_3 + I_2 + H_2O \rightleftharpoons H_2SO_4 + 2NaI \quad (4)$$

When the amount of iodine added is not enough to react with all the amount of sulfite ions according to equation (4), an equilibrium pontetial between a small amount of $Cu^{+}$ contained as an impurity in the chemical copper plating solution and a very small amount of free $Cu^{+2}$ can be measured, using gold-calomel electrode, platinum-calomel electrode, gold-silver chloride (0.1 N HCl) electrode, or platinum-silver chloride (0.1 N HCl) electrode and the following equation (5) is established.

$$E = 0.153V_{vs}NHE - 0.0592 \log \{k(n-1)[Cu^{+}]\}[V] \quad (5)$$

wherein k is a stability constant between $Cu^{+2}$ and the complexing agent, and (n−1) is a difference in concentration between the complexing agent and $Cu^{+2}$.

When the amount of iodine added is in excess of the amount to react with all the amount of sulfite ions according to equation (4), an equilibrium potential between the iodine and the iodine ions is measured using the same electrode as used in the measurement as the equation (5), and the following equation (6) is established.

$$E = 0.54V_{vs}NHE - 0.03 \log \{[I_3^{-}]/[I^{-}]^2\}[V] \quad (6)$$

The amount of formaldehyde can be determined be detecting the change in potential from that of equation (5) to that of equation (6). When the measured potential differs from the potential of the fresh plating solution, a control unit is driven to make up the plating solution with a supplementing solution, and the amount of formaldehyde in the plating solution can be kept equal to that of the fresh plating solution thereby.

According to the present invention, the concentrations of $Cu^{+2}$ ions and a complexing agent can be measured and controlled in the following manner.

Generally, the complexing agent is contained in the chemical copper plating solution at a concentration 1.5 to 5 times as high as the concentration of copper ions. Copper ions are stabilized as a complex compound. A complexing agent (for example, ethylenediaminetetracetic acid and ethylenediaminepentaacetic acid) reacts with so many kinds of metal ions including the copper ions at a molar ratio of 1:1.

Now, suppose that the concentration of copper ions in a chemical copper plating solution be C moles, and the concentration of a complexing agent be nC moles. The copper ions are almost completely complexed. An equilibrium potential between the $Cu^{+}$ ions contained as an impurity in the plating solution and a very samll amount of free $Cu^{+2}$ is measured in that state, using, for example, gold-calomel electrode, platinum-calomel electrode, gold-silver chloride (0.1 NHCl) electrode, or platinum-silver chloride (0.1 NHCl) electrode, and the equation (5) is established.

$$E = 0.153V_{vs}NHE + 0.0592 \log \{k(n-1)[Cu^{+}]\}(V) \quad (5)$$

wherein k is a stability constant between $Cu^{+2}$ and the complexing agent.

To a definite volume of a plating solution having the established relation according to the equation (5) is added a metal ion capable of forming a more stable complex compound than the copper ions (for example, $Fe^{+3}$, $Tl^{+3}$, $Hg^{+2}$ or $In^{+3}$) or $Cu^{+2}$ and HCOONa, or a metal ion capable of forming a stable complex compound like $Cu^{2}$ (for example, $Zn^{+2}$, $Ni^{+2}$, or $Ti^{+3}$) and HCOONa. When the amount of the metal ion added is in a little excess of the difference in concentration between the complexing agent and $Cu^{+2}$, that is, (n−1)C moles, the complexed $Cu^{+2}$ is dissociated to release free $Cu^{+2}$. The potential of the plating solution in this state can be represented by the following equation (7), when measured by said insoluble electrode.

$$E = 0.153V_{vs}NHE + 0.0592 \log \{[Cu^{+2}]/[Cu^{+}]\}[V] \quad (7)$$

When $Cu^{+2}$ is consumed by the plating reaction, the concentration of free complexing agent is increased, and all the amount of the metal ions added is complexed with the free complexing agent to establish a potential according to the equation (5). Thus, the concentration of free complexing agent can be determined by detecting the change in potential of a plating solution from equation (5) to equation (7), and since the amount of $Cu^{+2}$ and the amount of the complexing agent in the fresh plating solution are known, the concentration of $Cu^{+2}$ can be indirectly determined. When the measured potential differs from the potential of the fresh plating solution, a control unit is driven to supply a supplementing solution, and the concentration of $Cu^{+2}$ can be kept equal to that of the fresh plating solution.

When the amount of the metal ion added (for example, $Fe^{+3}$, or $FeCl_3$ or $Fe_2(SO_4)_3(NH_4)_2SO_4.24H_2O$ as compounds) is in a little excess of the amount for the formation of the complex compound with all the amount of the complexing agent, that is, nC moles, free $Fe^{+3}$ is formed in the plating solution, and an equilibrium potential between the free $Fe^{+3}$ and a small amount of $Fe^{+2}$ existing as an impurity in the plating solution can be detected using the same insoluble electrode as used above and the following equation (8) is established.

$$E=0.771V_{vs}NHE+0.0592 \log \{[Fe^{+3}]/[Fe^{+2}]\}(V) \quad (8)$$

That is, all the amount of the complexing agent can be determined by detecting the change in potential of the plating solution from equation (7) to equation (8). When the measured potential differs from the potential of the fresh plating solution, a control unit is driven to supply a supplementing solution, and all the amount of the complexing agent can be kept equal to that of the fresh plating solution thereby.

BRIEF DESCRIPTION OF THE DRAWING

Single FIGURE is a flow diagram of an apparatus for continuously and automatically controlling a chemical copper plating solution.

DETAILED DESCRIPTION OF THE PREFERRED EMBODIMENTS

The present invention will be described in detail below, referring to Examples.

EXAMPLE 1

In FIGURE, a chemical copper plating solution (composition: 13 g of $CuSO_4.5H_2O$, 40 g of EDTA-2Na, 3 g of HCHO, a trace of an additive, 11.5 g of NaOH, and water in an amount of making the solution 1 l; pH: 12.3) is sampled continuously at a rate of 50 ml/hr from a plating tank 1 by a multi-tube pump 2. 50 ml/hr of an aqueous 0.115 NHCl solution as an acid solution is added to the sampled chemical copper plating solution from an acid solution tank 9 through the multi-tube pump 2. The pH of the resulting mixed solution is measured as a potential by means of a pH detection cell 4 between a glass electrode 4' and a calomel electrode 4'' (reference electrode). When there is no change in the pH of the plating solution, the pH will remain at 7.3. When the measured potential is found to be smaller than the potential corresponding to the set value, pH 7.3, of the pH control unit 16, the difference in potential is emitted as a signal, and an electromagnetic valve 23 is opened thereby, and an alkali solution (composition: 200 g of NaOH and water in an amount of making the solution 1 l) is supplied to the plating tank 1 from an alkali solution supplementing tank 19. When the pH measured as a potential by the pH detection cell 4 is higher than the set value, 7.3, the electromagnetic valve 23 is closed and the supply of the alkali solution to the plating tank 1 is discontinued, and thus the pH is controlled thereby. The pH control can be made with an accuracy of ±3%, if the set value of the pH control unit is adjusted to the potential corresponding to the pH of 4–9. When the set value is found to be lower than the potential corresponding to pH 4, or higher than the potential corresponding to pH 9, the control accuracy will be deteriorated. 100 ml/hr of the sampled solution leaving the pH detection cell 4 is then mixed with 50 ml/hr of a first titrating solution (composition: 9.01 g of $FeCl_3$, 5 ml of HCl and water in an amount of making the solution 1 l) from a first titrating solution tank 10 through the multi-tube pump 2 to make pH 1.5, and the resulting mixed solution enters a copper ion detection cell 5, where the potential of the mixed solution is detected between a platinum electrode 5' (insoluble electrode) and a calomel electrode 5'' (they can be a gold electrode and a calomel electrode, respectively). When the detected potential is found to be smaller than the set potential, 0.12 V, of a copper ion control unit 15, the difference in potential is emitted as a signal to open an electromagnetic valve 24, and a copper sulfate solution (composition: 200 g of $CuSO_4.5H_2O$ and water in an amount of making the solution 1 l) is supplied to the plating tank 1 from a copper ion supplementing tank 20. When a higher potential than the set value 0.12 V is detected by the copper ion detection cell 5, the electromagnetic valve 24 is closed, and the supply of the copper sulfate solution is discontinued. That is, the concentration of copper ion is controlled thereby with a control accuracy of ±3%. The sampled solution leaving the copper ion detection cell 5 is then mixed with 50 ml/hr of a second titrating solution (composition: 8.43 g of $FeCl_3$, 5 ml of HCl, and water in an amount of making the solution 1 l) through the multi-tube pump 2 from a second titrating solution tank 11 to make pH 1.5, and the resulting mixed solution enters a complexing agent detection cell 6, where the potential is detected between a platinum electrode 6' and a calomel electrode 6'' (they can be a gold electrode and a calomel electrode, respectively). When the detected potential is found to be higher than the set potential, 0.33 V, of a complexing agent control unit 14, a difference in potential is emitted as a signal to open an electromagnetic valve 25, and a complexing agent supplementing solution (composition: 100 g of EDTA-2Na and water in an amount of making the solution 1 l) is supplied to the plating tank 1 from a complexing agent supplementing tank 21. When the potential is found to be smaller than the set value, 0.33 V, the electromagnetic valve is closed, and the supply of the complexing agent supplementing solution is discontinued. Thus, all the concentration of the complexing agent is controlled thereby with a control accuracy of ±3%. The sampled solution leaving the complexing agent detection cell 6 is then discharged into a wate liquor tank 12.

On the other hand, 50 ml/hr of the plating solution sampled from the plating tank 1 by the multi-tube pump 2 is admixed with 50 ml/hr of a sulfite solution (composition: 18.909 g of $Na_2SO_3$ and water in an amount of making the solution 1 l) from a sulfite solution tank 8 by the multi-tube pump 2 to make pH 10, and then with 50 ml/hr of an iodine solution (composition: 40 g of KI, 12.69 g of $I_2$, 50 g of $KH_2PO_4$, 50 g of $K_2HPO_4$ and water in an amount of making the solution 1 l) from an iodine solution tank 7 by the multi-tube pump 2 to make pH 7. The resulting mixed solution enters a formaldehyde detection cell 3, where a potential is detected between a platinum electrode 3' and a calomel electrode 3'' (they can be a gold electrode and a calomel electrode, respectively). When the detected potential is lower than the set potential, 0.1 V, of a formaldehyde detection control unit 17, a difference in potential is emitted as a signal to open an electromagnetic valve 22, and a formaldehyde supplementing solution (composition: 200 ml of 37% formalin and water in an amount of making the solution 1 l) is supplemented to the plating tank 1 from a formaldehyde supplementing tank 18, and the concentration of formaldehyde is controlled thereby with a control accuracy of ±3%. The sampled solution leaving the formaldehyde detection cell is then discharged into a waste liquor tank 13.

When 50 ml/hr of a sulfite solution (composition: 18.909 g of $Na_2SO_3$, 0.2 ml of conc $H_2SO_4$ and water in an amount of making the solution 1 l) is added to the sampled plating solution in place of said sulfite solution, the pH of the resulting mixed solution is 9, and the sulfite ions are decomposed, making the analysis impossible. When 50 ml/hr of an iodine solution (composition: 40 g of KI, 12.6 g of $I_2$, 50 g of $KH_2PO_4$ and water in an amount of making the solution 1 l) is added to the sampled plating solution in place of said iodine solution, the pH of the resulting mixed solution is 6, and when 50 g/hr of an iodine solution (composition: 40 g of KI, 12.6 g of $I_2$, 50 g of $K_2HPO_4$, and water in an amount of making the solution 1 l) is added to the sampled plating solution in place of said iodine solution, the pH of the resulting mixed solution is 8, and the analysis is possible in the latter two cases.

EXAMPLE 2

Control of a chemical copper plating solution is carried out in the same manner as in Example 1, except that: glass electrode-silver chloride electrode are used as the pH detecting electrode, either platinum-silver chloride electrode or gold-silver chloride electrode is used for measuring the concentrations of copper ions, complexing agent and formaldehyde, with the set potential of the pH control unit corresponding to pH 7.8, the set potential, 0.08 V, of the copper ion control unit, the set potential, 0.07 V, of the complexing agent control unit, and the set potential, 0.1 V, of the formaldehyde control unit, and a first titrating solution, a second titrating solution, a sulfite solution, and an iodine solution with the following compositions are used.

First titrating solution:
$CuSO_4.5H_2O$: 14.1 g
HCOONa: 64 g
HCl: 20 ml
Water: an amount of making the solution 1 l 50 ml/hr of the chemical copper plating solution is admixed with 50 ml/hr of the first titrating solution. The pH of the resulting mixed solution is 5.

Second titrating solution:
Iron alum: 25.1 g
Triethylenetetramine: 50 ml
HCl: 100 ml
Water: an amount of making the solution 1 l 50 ml/hr of the chemical copper plating solution is admixed with 50 ml/hr of the second titrating solution. The pH of the resulting mixed solution is 1.5. A solution of iron alum in hydrochloric acid and triethylenetetramine can be separately added to the plating solution.

Sulfite solution:
$Na_2SO_3$: 18.909 g
$Na_2SO_4$: 50 g
NaOH: 4 g
Water: an amount of making the solution 1 l 50 ml/hr of the chemical plating solution is admixed with 50 ml/hr of the sulfite solution. The pH of the resulting mixed solution is 12.

Iodine solution:
KI: 40 g
$I_2$: 12.69 g
$KH_2PO_4$: 50 g
$K_2HPO_4$: 50 g
Water: an amount of making the solution 1 l 50 ml/hr of the chemical copper plating solution is admixed with 50 ml/hr of the iodine solution. The pH of the resulting mixed solution is 7.

Similar results to those of Example 1 can be obtained.

As described above, a chemical copper plating solution can be continuously controlled with a good accuracy according to the present invention. Furthermore, the present apparatus for controlling a chemical copper plating solution can detect pH, concentrations of copper ions, reducing agent, and complexing agent all as potentials, and thus requires no such expensive conversion as the conversion of transmitted light to an electric signal in a colorimeter, etc., and thus the present apparatus is less expensive.

What is claimed is:

1. A process for controlling a composition of a chemical copper plating solution, which comprises:

(a) continuously adding an acid solution to a definite volume of an alkaline chemical copper plating solution continuously sampled from a chemical plating tank, thereby making pH 4–9, measuring a potential of the resulting solution by a glass electrode-reference electrode, emitting a difference in potential as a signal, when the measured potential is lower than a set potential of a pH control unit, thereby supplying an alkali solution to the plating tank from an alkali supplementing solution tank, or when the measured potential is higher than the set potential, thereby discontinuing the supplying of the alkali solution thereto, and thereby keeping the pH of the plating solution in the plating tank continuously constant, (b) continuously adding to the solution leaving the pH measurement a definite volume of metal ions capable of forming a complex compound with a complexing agent in a little excess of the amount of free complexing agent in the solution, measuring a potential of the resulting solution by an insoluble electrode and a reference electrode, supplying a copper ion supplementing solution to the plating tank when the measured potential is lower than a set potential of a copper ion control unit, or discontinuing the supplying of the copper ion supplementing solution thereto when the measured potential is higher than the set potential, and thereby keeping a concentration of copper ions in the plating solution in the plating tank continuously constant, (c) continuously adding to the solution leaving the measurement of copper ion concentration a definite volume of metal ions capable of forming a complex compound with a complexing agent in a little excess of all the amount of complexing agent in the solution, measuring a potential of the solution by an insoluble electrode and a reference electrode, supplying a complexing agent supplementing solution to the plating tank when the measured potential is higher than a set potential of a complexing agent control unit, or discontinuing the supplying of the supplementing solution when the measured potential is lower than the set potential, and thereby keeping a concentrtion of the complexing agent in the plating tank continuously constant, and (d) continuously adding a definite volume of sulfite ions and iodine to a definite volume of a chemical copper plating solution continuously sampled from the chemical plating tank, measuring a potential of the resulting solution by an insoluble electrode and a reference electrode, supplying a reducing agent supplementing solution to the plating tank when the measured potential is lower than a set potential of a reducing agent control unit, or discontinuing the supplying of the supplementing solution thereto, when the measured potential is higher than the set potential, and thereby keeping a concentration of reducing agent in the plating solution in the plating tank continuously constant.

* * * * *